United States Patent [19]

Smith

[11] Patent Number: 4,542,699

[45] Date of Patent: Sep. 24, 1985

[54] POWERED RADIAL TRUCK

[75] Inventor: Roy E. Smith, Kingston, Canada

[73] Assignee: Urban Transportation Development Corporation Ltd., Toronto, Canada

[21] Appl. No.: 660,345

[22] Filed: Oct. 12, 1984

[30] Foreign Application Priority Data

Nov. 25, 1983 [CA] Canada ..... 441943

[51] Int. Cl.[4] ..... B61C 9/48; B61F 5/38

[52] U.S. Cl. ..... 105/99; 105/131; 105/133; 105/165

[58] Field of Search ..... 105/26 R, 96, 133, 135, 105/136, 138, 139, 182 R, 182 E, 99, 165, 131, 167, 168

[56] References Cited

U.S. PATENT DOCUMENTS 188,672 3/1877 Pyott ..... 105/138

1,061,146 5/1913 Towle ..... 105/165

4,164,188 8/1979 Hallam et al. ..... 105/135

FOREIGN PATENT DOCUMENTS 492249 9/1938 United Kingdom ..... 105/133

2034651 6/1980 United Kingdom ..... 105/135

*Primary Examiner*—Robert B. Reeves

*Assistant Examiner*—Dennis C. Rodgers

*Attorney, Agent, or Firm*—Rogers, Bereskin & Parr

[57] ABSTRACT

In a powered truck or bogie for a railway vehicle having steerable wheelsets which pivot with respect to the truck or bogie frame, the motor for each wheelset is mounted to the truck or bogie frame and coupled to the drive transmitting means by a flexible coupling having a substantially vertical pivotal axis which axis is coincident with the real or virtual pivotal axis of the wheelset with respect to the truck or bogie.

6 Claims, 4 Drawing Figures

POWERED RADIAL TRUCK

Figure 1:
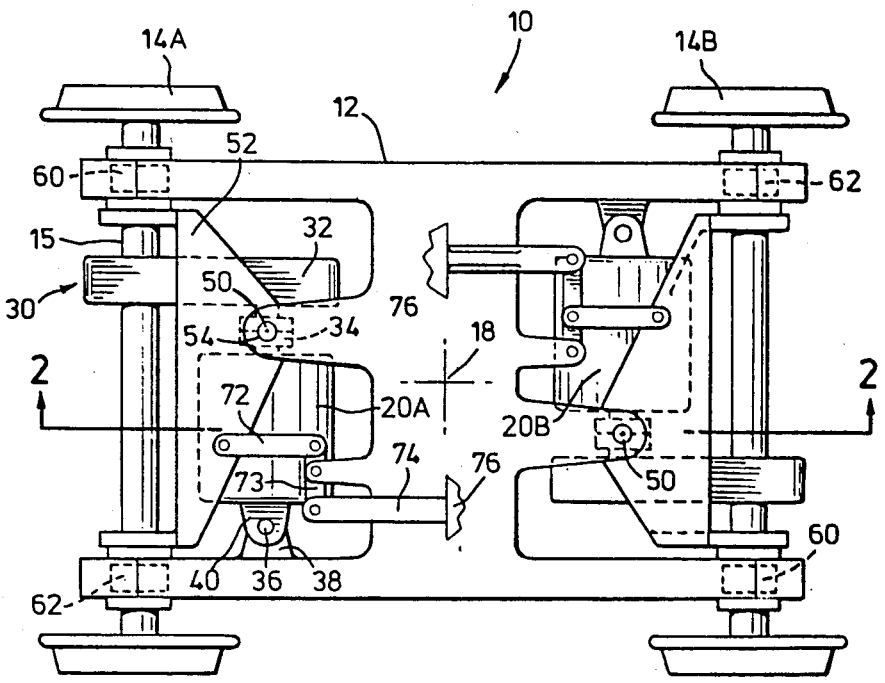

This invention relates to means for mounting motors on railroad trucks where such trucks have wheelsets which are adapted to move to a substantially radial configuration when such trucks are travelling on curved railway track.

In railway vehicles of the type typically used for mass transit it is common to provide vehicles which are self propelled. The typical vehicle comprises a relatively short wheel base truck located substantially near each end of the vehicle. The trucks are affixed to the vehicle for relative pivotal motion between the truck and the vehicle in order to allow for pivotal movement when the vehicle is travelling on curved track. As the truck pivots with respect to the vehicle the motor is typically mounted on the truck rather than on the vehicle. One or more wheel sets of the vehicle may be powered.

With the typical short wheel base truck widely used in railroad vehicles today the two wheel sets remain parallel to each other at all times. When such a truck is travelling on curved track it is impossible for each of the wheelsets to assume the radial configuration. Thus the wheelsets must involve a certain amount of slipping when travelling on curved track and in extreme situations the flanges of the wheels will contact the rails causing substantial wear and in extreme situations, derailment of the truck. Thus it has long been realized that it is highly desirable to allow the wheelsets to be steered to a radial configuration.

In typical powered railway trucks the wheelsets remain parallel to each other and fixed with respect to the frame of the truck. Thus, the motor may be mounted on the truck frame as there is no relative motion between the truck frame and the wheelset. This is not so when the vehicle is fitted with steerable axles. In the interest of economy, it is often found desirable in powered railway trucks to mount a gear box directly on the axle, by press fit or similar rigid means, and to drive the input shaft of the gear box by a motor which may be hung from one end on the truck frame and the other on the gear box. The gear box may be of the right angle type in which case the motor axis will be perpendicular to the axle, or of the parallel type in which the motor will be parallel to the axle. With either of these arrangements it is necessary, when steering the wheelsets, to allow the gear boxes and motors to move with them. This necessity is deterimental to the operation of the truck in two ways. Firstly, it requires accommodation to be provided for the steering motion in the mounting of the motor to the frame and secondly, the motor mass being attached to the axle, adds to the difficulty of stabilizing the wheelset against undesirable oscillating motions.

It has been found that the above problems can be overcome if the substantially vertical axis of steering of a wheelset is located so as to be substantially coincident with the centre of the flexible coupling joining the motor to the gear box. By locating the steering axis at this point, the motor will have no tendency to move relative to the frame during steering of the wheelsets and therefore no special provision will be needed to accommodate it. Also, as the motor does not move with the wheelset during steering its inertia is not added to the wheelset inertia in determining the restraint necessary to prevent "hunting" oscillations.

The pivot point for the wheelsets may be provided by a direct physical pivot joint at the required location or the wheelset may be constrained so as to move only about this point, through constraints elsewhere, thus providing a virtual pivot. In both instances the steering input may be provided by any of a variety of mechanisms well known in the railway art.

According to the invention, a motor driven truck for a railroad vehicle comprises; frame means, means to pivotally attach a railroad vehicle body to the truck, at least two railroad wheel sets adapted to support said frame, said at least two wheel sets attached to said frame means for relative pivotal movement between each of said wheelsets and said frame about a first respective pivotal axis for each wheelset whereby said wheelsets may move to a radial alignment when said truck is travelling on curved track, at least one motor supported by said frame, drive transmitting means connecting said motor and one of said wheel sets, said drive transmitting means comprising a flexible coupling to permit relative angular displacement between said motor and said wheelset about a second axis, the first axis of said driven wheelset substantially coinciding with said second axis.

Figure 2:
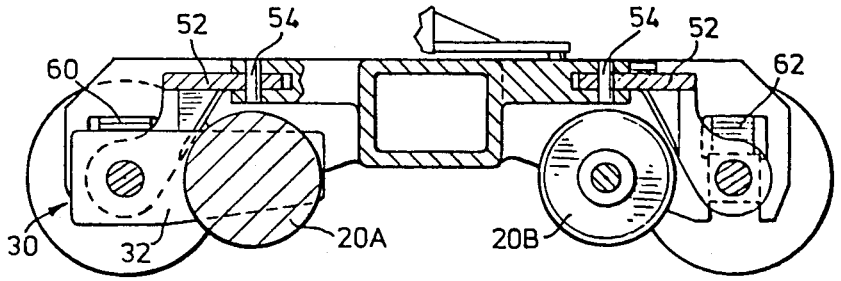
Figure 3:
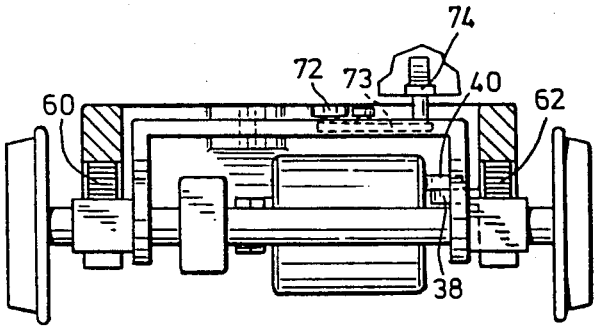
Figure 4:
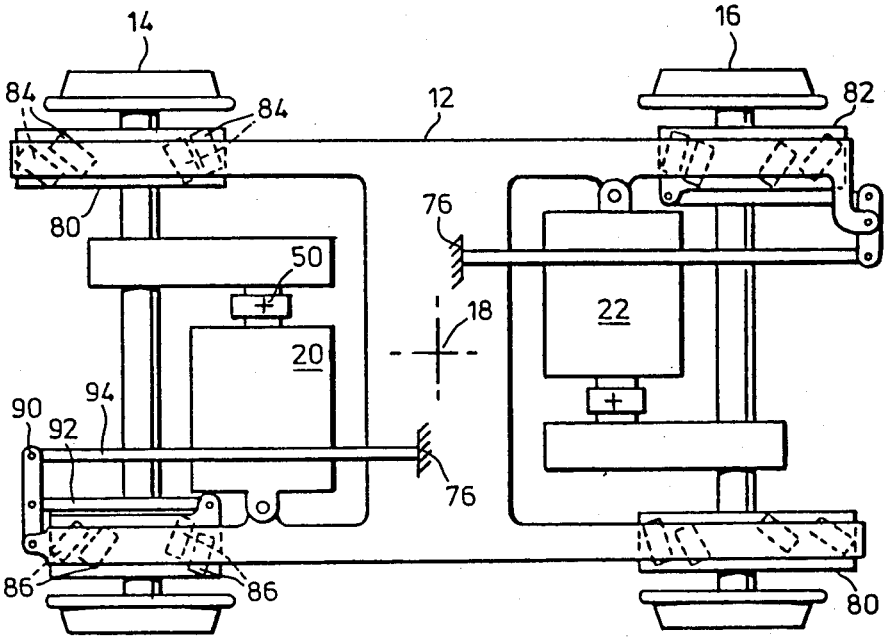

The invention will be better understood by reference to the following description of two preferred embodiments of the invention and in which:

FIG. 1 is a schematic plan view of a powered radial truck having wheelsets affixed to the truck for pivotal movement about a pivotal connection, FIG. 2 is a sectional view of the truck of FIG. 1 along line 2—2, FIG. 3 is a front vertical view in partial section of the truck of FIG. 1, and FIG. 4 is a plan view of an alternate embodiment of a powered truck in which the wheel sets are mounted for movement about a virtual vertical pivotal axis.

The truck of FIG. 1 indicated generally at 10 comprises frame means 12 supported on wheelsets 14A and 14B. The truck frame means 12 is adapted to receive a bolster upon which the car body can be mounted. For clarity in illustrating the motor mounting means of the truck the bolster has not been illustrated. The bolster provides pivotal movement between the truck frame 12 and the car body mounted on the truck about the vertical pivotal axis identified by the numeral 18.

Wheelset 14A is driven by motor 20A and wheelset 14B is driven by motor 20B. It is not necessary that both wheelsets be powered. The drawings however illustrate that there is ample room to provide two motors. The motors and their associated drive mechanisms and mounting means are essentially identical. The mounting means and drive interconnections between wheelset 14A and motor 20A will now be described in greater detail, it being understood that similar parts bear similar numbers interconnecting wheelset 14B and its drive motor 20B.

The drive transmitting means indicated generally at 30 for coupling the motor to the wheelset comprises a gear box 32 affixed to the axle 15 of the wheelset and a flexible coupling 34 attaching the output of the drive motor to the gear box 32. The gear box 32 is rigidly attached to the axle and moves with the wheelset as a fixed unit when the wheelset pivots relative to the frame 12 while travelling on curved track.

The motor is supported by the frame means 12 for pivotal movement about a substantially vertical axis indicated at 36. As is most clear in FIG. 3, the motor mounting means comprises a flange 38 which is part of the frame means 12. Overlying flange 38 and supported thereby is a flange 40 which is part of the motor housing. A bolt or axle passing through flanges 38 and 40 comprises the pivotal axis 36.

The flexible coupling 34 between the motor and the gear box 32 supports the other end of the motor and permits relative angular movement between the motor and the gear box 32. The flexible coupling 32 may comprise a pair of flanges with resilient coupling means bolted therebetween to permit relative angular displacement.

In the embodiment shown in FIGS. 1, 2 and 3 wheelsets 14A and 14B are affixed to the frame means 12 for movement about a generally vertical pivotal axis designated by the numeral 50. The wheelset is mounted in a substantially yoke-shaped member 52 which is pivotally affixed to the frame means 12 about a substantially vertical pin 54. It will be observed that the pin 54 is substantially aligned with the pivotal axis of the flexible connection 34. Thus the pivotal axis 50 passes through the axis of pin 54 and through the effective axis of movement of the flexible connection 34 of the drive transmitting mechanism 30.

It will be observed from reference to the figures that the yoke 52 does not carry any substantial portion of the weight of the vehicle supported on the truck. Rather, the frame means 12 is supported by the wheelsets by means of bearing blocks 60 and 62 illustrated in FIG. 1 and FIG. 3. Bearing blocks 60 and 62 are substantially rigid in the vertical direction but yieldable in shear in the horizontal direction, thus permitting sufficient movement of the wheelset relative to the frame so as to allow the wheelset to move to a radial alignment when travelling on curved track.

The wheelsets are guided to the radial position by means of a steering mechanism indicated in FIG. 1. The steering mechanism comprises a first lever 72 pivotally affixed to yoke 52. Lever 72 is attached to a connecting link 73, pivotally affixed to the frame 12 and to a second steering lever 74. Steering lever 74 is attached to the body 76 of the vehicle at a point which is not coincident with the vertical axis 18. Thus, as the truck rotates relative to the body portion as the vehicle travels on curved track, steering lever 74 will move causing pivotal movement of the connecting link 73 and lever 72 thus causing pivotal movement of the yolk 52 about axis 50.

It will be observed from reference to FIG. 1 that as the yoke 52 moves about vertical axis 50 the gear box 32 will also rotate about axis 50. Such movement will change the angular relationship between the gear box 32 and the motor but will not cause any substantial movement of the motor. Thus, the motor 20 could be rigidly mounted to the frame means 12 except that in most circumstances manufacturing and operating tolerances are such that the motor is preferably resiliently supported by the frame means 12.

The embodiment illustrated in FIG. 4 is substantially similar to that discussed above and like numbers have been used for like parts throughout. The mechanism to mount wheelsets 14A and 14B to the frame means 12 and the steering mechanism are however substantially different. In this embodiment the wheel-sets are mounted in bearing means 80 and 82 respectively. The frame means 12 is supported on the bearing means 80 through four resilient shear blocks 84. The shear blocks 84 are shown in phantom outline. Each of the shear blocks 84 is substantially rigid in the vertical direction and in its longitudinal direction but yields in shear in the transverse direction. The longitudinal axis of each of the shear blocks 84 is shown in dotted lines. The dotted lines converge at the vertical axis 50. Similar shear blocks 86 are used to support the frame means 12 on the bearing means 82. These shear blocks are also shown in phantom outline with their longitudinal axes indicated by the dotted lines. It will be observed by reference to FIG. 4 that the dotted lines for the shear blocks 86 also coincide with the vertical axis 50.

The effect of the orientation of the shear blocks 84 and 86 is that the wheelset is substantially free to rotate about a virtual pivotal axis coincident with axis 50 but is otherwise constrained with respect to frame 12. Any motion other than the desired rotation about the vertical pivot would require compression deflection of the resilient material which it will resist. Thus the wheelset moves about a virtual pivotal axis which virtual axis is coincident with the axis of the pivotal connection 34 between the transmission 32 and the motor 20.

Bearing means 82 is steered by means of the steering mechanism indicated generally at 90. The steering mechanism comprises a first lever 92 pivotally affixed to the bearing means 82. Steering lever 92 is pivotally affixed to the connecting link 93 which is pivotally affixed to the frame means 12 and also to a second steering lever 94. Steering lever 94 is pivotally connected to the car body 76 and operates in substantially the same means as steering lever 74 described above. Movement of the car body about pivotal axis 18 with respect to the frame means 12 causes movement of lever 94 which in turn causes pivotal movement of the bearing means 82 relative to the frame 12 allowing the wheelset to be guided to its radial configuration.

In each of the embodiments illustrated in the figures the gear box 32 is of the so-called parallel drive type. Thus, the axis of the motor is substantially parallel to the axis of the wheel set. It is not necessary to use a parallel drive gear box. If the gear box is of the right angle drive type then the motor may be mounted perpendicular to the axle if this is desired. In the figures as illustrated the drive mechanism comprises a gear box which is driven through a flexible coupling which turns at motor speed. Where desirable, the gear box may be incorporated with the motor and made rigid thereto with a non-reduction drive transmitting means transmitting the driving force from the gear box to the wheel set. In such a case the flexible drive transmitting connection 34 would be between the transmission and the drive transmitting means or between it and the axle.

Various other changes and modifications may be made by those skilled in this art without departing from the scope of the invention as more clearly described in the following claims.

I claim:

1. A motor driven truck for radial vehicles comprising:

frame means, means to pivotally attach a railroad vehicle body to said truck, at least two railroad wheelsets adapted to support said frame; said at least two wheelsets attached to said frame means for relative pivotal movement between each of said at least two wheelsets and said frame about first respective pivotal axes, whereby said wheelsets may move to a radial alignment when travelling on curved track, at least one motor supported by said frame, drive transmitting means connecting said at least one motor and one of said wheelsets said drive transmitting means comprising a flexible coupling to permit relative angular displacement between said at least one motor and said one of said wheelsets about a second axis the first axis of said one of said wheelsets coinciding with said second axis.

2. The truck of claim 1 having steering means for guiding said at least two wheelsets to a radial alignment when said truck is on curved track.

3. The device of claim 2 wherein said drive transmitting means includes a transmission means carried by said one of said wheelsets and fixed thereto to prevent respective angular movement and said flexible coupling is located between said motor and said transmission means.

4. The device of claim 2 wherein said at least one motor includes transmission means fixed thereto to prevent relative angular movement and said flexible coupling is located between said transmission means and said axle.

5. The device of claim 2 wherein said frame means includes a main frame and a subframe for each of said at least two wheelsets and each of said subframes is pivotally affixed to said main frame.

6. The device of claim 2 wherein each of said at least two wheelsets is attached to said frame means by a plurality of resilient mounting means deformable in shear to comprise a pivotal connection to said frame about a virtual axis said virtual axis comprising said first respective axis.

* * * * *